US011794989B2

(12) United States Patent
Archer, Jr.

(10) Patent No.: US 11,794,989 B2
(45) **Date of Patent: *Oct. 24, 2023**

(54) PRE-ASSEMBLED, SELF CONTAINED, PORTABLE FLUID STORAGE TANK AND METHOD OF HANDLING FLOWBACK FLUIDS FROM A HYDROCARBON PRODUCTION OPERATION USING SAID TANK

(71) Applicant: Jeffery Kevin Archer, Jr., Houston, TX (US)

(72) Inventor: Jeffery Kevin Archer, Jr., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/441,274

(22) PCT Filed: Mar. 21, 2020

(86) PCT No.: PCT/US2020/024089
§ 371 (c)(1),
(2) Date: Sep. 20, 2021

(87) PCT Pub. No.: WO2020/191388
PCT Pub. Date: Sep. 24, 2020

(65) Prior Publication Data

US 2022/0153516 A1 May 19, 2022

Related U.S. Application Data

(60) Provisional application No. 62/821,957, filed on Mar. 21, 2019.

(51) Int. Cl.
*B65D 90/24* (2006.01)
*B65D 88/52* (2006.01)
(Continued)

(52) U.S. Cl.
CPC ..... *B65D 90/24* (2013.01); *B65D 88/524* (2013.01); *B65D 90/046* (2013.01);
(Continued)

(58) Field of Classification Search
CPC ..... B65D 90/00; B65D 90/04; B65D 90/023; B65D 90/0033; B65D 90/24;
(Continued)

(56) References Cited

U.S. PATENT DOCUMENTS 2,690,778 A * 10/1954 Walsh ..... B65D 88/16 220/666
2,749,956 A * 6/1956 Eldred ..... B65D 88/522 220/9.3

(Continued)

*Primary Examiner* — Nicolas A Arnett
(74) *Attorney, Agent, or Firm* — Karen B. Tripp

(57) ABSTRACT

Pre-assembled, self-contained, portable tank and method of using the tank for storing backflow fluids during hydrocarbon production operations. Tank is rapidly deployable and has a collapsible and refillable bladder for storing approximately 50,000 gallons or 1200 BBLS of fluids and a secondary containment with a holding capacity 120% of that of the bladder. When closed for transport, the tank is sufficiently compact and light to be movable with a light body pickup truck with an accompanying trailer over public roadways. After delivery to a site, a crew of two to five persons can set-up the tank for use within about 20 to 120 minutes.

21 Claims, 16 Drawing Sheets

(51) Int. Cl.
*B65D 90/04* (2006.01)
*B65D 90/20* (2006.01)
*E21B 41/00* (2006.01)
*E21B 43/26* (2006.01)

(52) U.S. Cl.
CPC ..... *B65D 90/205* (2013.01); *E21B 41/00* (2013.01); *B65D 2590/046* (2013.01); *E21B 43/26* (2013.01)

(58) Field of Classification Search
CPC .. B65D 90/046; B65D 90/205; B65D 88/524; E21B 41/00; E21B 43/26
See application file for complete search history.

(56) References Cited

U.S. PATENT DOCUMENTS 2,915,097 A * 12/1959 Lewis ..... B65D 90/205 220/666
4,121,389 A * 10/1978 Ptaszek ..... B65D 88/16 52/192
6,609,863 B1 * 8/2003 Morioka ..... B65D 90/046 383/61.3
6,758,361 B2 * 7/2004 Hunt ..... B65D 88/16 220/4.12
7,188,747 B2 * 3/2007 Bennett ..... B65D 90/205 220/9.2
7,299,513 B1 * 11/2007 Barrett ..... B65D 88/16 5/655.5
7,360,784 B2 * 4/2008 Stewart ..... B60J 7/1614 280/30
8,365,937 B2 * 2/2013 Lovelace ..... B65D 90/205 220/4.12
8,434,638 B2 * 5/2013 McKenzie ..... E21B 43/26 280/837
8,746,478 B2 * 6/2014 Claeys ..... B65D 90/205 220/9.3
9,157,205 B1 * 10/2015 Novotny ..... B65D 90/047
9,284,113 B2 * 3/2016 Corbeil ..... B65D 88/748
9,403,640 B1 * 8/2016 Crain ..... B65D 88/54
9,586,753 B2 * 3/2017 Hanson ..... B65D 88/744
9,757,665 B2 * 9/2017 Warner ..... C02F 1/40
9,957,104 B2 * 5/2018 Hindbo ..... B65D 88/16
10,518,967 B2 * 12/2019 Claeys ..... B65D 90/205
10,577,177 B2 * 3/2020 Harvey ..... B65D 90/24
10,717,596 B1 * 7/2020 Archer, Jr. ..... E21B 41/00
2012/0138630 A1 * 6/2012 Kinsey, III ..... B65D 88/748 222/23
2013/0186890 A1 * 7/2013 Moody ..... B65D 90/08 220/4.16
2013/0319552 A1 * 12/2013 Svarczkopf ..... F17D 1/08 220/4.16
2014/0166649 A1 * 6/2014 Hoopes ..... E02D 19/04 220/4.12
2015/0096980 A1 * 4/2015 Laing ..... B65D 90/24 220/9.4
2015/0166260 A1 * 6/2015 Pham ..... B65D 90/48 414/812
2016/0229626 A1 * 8/2016 Claeys ..... B65D 88/005

* cited by examiner

PRE-ASSEMBLED, SELF CONTAINED, PORTABLE FLUID STORAGE TANK AND METHOD OF HANDLING FLOWBACK FLUIDS FROM A HYDROCARBON PRODUCTION OPERATION USING SAID TANK

RELATED APPLICATION

This patent application claims priority from U.S. Provisional Patent Application No. 62/821,957, filed Mar. 21, 2019, the contents of which are incorporated herein by reference.

BACKGROUND OF THE INVENTION

1. Field of the Invention

This invention relates to storage tanks for fluids such as chemicals, hydrocarbons, and water produced in hydrocarbon recovery operations, for non-limiting example. This invention also relates to temporary storage of such fluids.

2. Description of Relevant Art

In certain places in the United States having oil production, such as North Dakota, there are, at times, weight restrictions on vehicles using roadways that prevent transport of production fluids such as hydrocarbons and produced water across the roadways in standard transport vehicles such as tanker trucks (Class 7 and higher under US GVWR classifications). Currently, the solution during the times the restrictions are in place is to delay the production until the restrictions are removed and the produced fluids can be transported again. Such delays are costly, however, and a better solution is needed.

Construction and installation of storage tanks at a wellsite to store produced fluids is an option that has been considered. However, installation of standard metal or fiberglass storage tanks is costly and time consuming and results in either too few tanks or tanks that go largely unused. Known temporary storage tanks have been considered, but those too fail to provide practical satisfactory storage solutions.

For example, WO International Patent Application Publication No. 2016/187653 of Dunsby et al teaches a transportable semi-permanent fluid storage apparatus but it requires mechanical assist for its complex on-site assembly and provides an open-air fluid container which is not useable for storing hydrocarbons, produced water, or potable water.

For another example, U.S. Pat. No. 9,957,104 of Hindbo teaches two temporary storage systems, one of which is a containment system for use by the oil industry for holding large volumes of water for fracking that uses a bladder supported by connectable or hinge-able panels that can be assembled and disassembled on site but the system provides no safety containment in the event the bladder structure leaks. Such a secondary containment is required by regulations related to storage of hydrocarbons and a number of other chemicals, and in certain locations, even water. The second system Hindo teaches is a silo like structure that requires heavy equipment, crews, tools, and costly time and assembly. Neither system satisfactorily meets industry needs.

A need continues to exist for temporary, safe, methods and apparatuses for storage of large quantities of fluids that are relatively low in cost and require minimal assembly and set-up for use.

SUMMARY OF THE INVENTION

The present invention provides a pre-assembled, self-contained, portable storage tank for storage of fluids or liquids that is low in cost, requires negligible or no assembly, and is simple and fast to set-up or deploy and to take down or prepare to store or redeploy. A crew of two to five persons can do it without need for digging a berm, without need of using a crane or a forklift to lift any part of the tank, and without need of assembling the tank beyond set-up procedures.

The storage tank comprises a collapsible and refillable bladder for receiving and storing the fluids or liquids and a secondary containment capable of holding 120% more fluids or liquids than the bladder. The bladder has or includes input and output connections or conduits associated with valves for configuring and controlling the flow of liquid into and out of and optionally even within the bladder.

When the tank is in use, the secondary containment is positioned beneath and at least partially along the sides of the bladder so as to contain any or all liquid from the bladder during any leakage from the bladder. An expandable and retractable frame holds or supports the bladder and the secondary containment. When the tank is not in use, the frame, secondary containment and the bladder can be folded or rolled back into a control mechanism housing for compact storage and transport. In preferred embodiments, the tank size does not require a permitted load, and does not exceed standard width, or weight restrictions for public roadways.

At least one electric winch, powered by at least one battery, backed up by a solar panel, can at least partially automate or otherwise assist with the unfolding, folding, rolling, unrolling, or storing, and optionally even draining of, the bladder or the secondary containment.

In one embodiment, the tank weighs less than 9000 lbs. When the tank is closed, for storage during non-use or transport, a control mechanism housing contains the winch (es), solar panel, one or more batteries, the bladder, secondary containment, and frame. In this closed position, the tank is sufficiently compact, for example, that in one embodiment it can be transported to a site for use by a class 1 to class 3 truck, such as a common light body pickup truck such as a Ford F-250 with an accompanying trailer.

The present invention also provides a method for temporary storage of backflow fluids during a fracking operation at a well site for enhanced recovery of hydrocarbons. The method comprises deploying near the well site the pre-assembled, self-contained, portable storage tank of the invention. Once deployed, the tank is connected to the flowline receiving the backflow fluids and the backflow fluids are allowed to flow or drain into the tank.

BRIEF DESCRIPTION OF THE DRAWINGS

In the drawings a more detailed and complete appreciation of the present invention and various advantages can be realized by reference to the detailed description that will accompany the drawings in which:

FIG. 1A shows one embodiment of a storage tank of the invention in the closed position being transported on a goose-neck trailer being pulled behind a pick-up truck.

FIG. 1B shows the storage tank of FIG. 1A being downloaded from the trailer at a field site where the storage tank is to be deployed.

FIG. 1C shows a side view of the storage tank of FIGS. 1A and 1B in place at the site, ready to be opened for use.

FIG. 1D is a side view of the storage tank of FIG. 1C, being opened and the frame of the tank being pulled out by two persons for positioning for use.

FIG. 1E is a top perspective view of the storage tank of FIG. 1D with the frame in place for use and two persons pulling out the secondary containment for positioning for use.

FIG. 1F is a top perspective view of the storage tank of FIG. 1E with the secondary containment in place on the frame with the sides or edges of the secondary containment attached to the sides of the frame.

FIG. 1G is a top perspective view of the storage tank of FIG. 1F with two persons pulling out the bladder over the secondary containment for positioning for use.

FIG. 1H is a top view of the storage tank of FIG. 1G with the bladder in place and ready for attachment to hoses or conduits for receiving fluid for storage in the bladder.

FIG. 10A illustrates the first pull of the winch on the secondary containment, which was spread out over the frame of the storage tank of one embodiment of the invention.

FIG. 10B illustrates the second pull of the winch on the secondary containment of FIG. 10A.

FIG. 10C illustrates the third pull of the winch on the secondary containment of FIG. 10B, showing the secondary containment folded and pulled into the control mechanism housing for storage.

DETAILED DESCRIPTION OF THE INVENTION

Figure 1A:
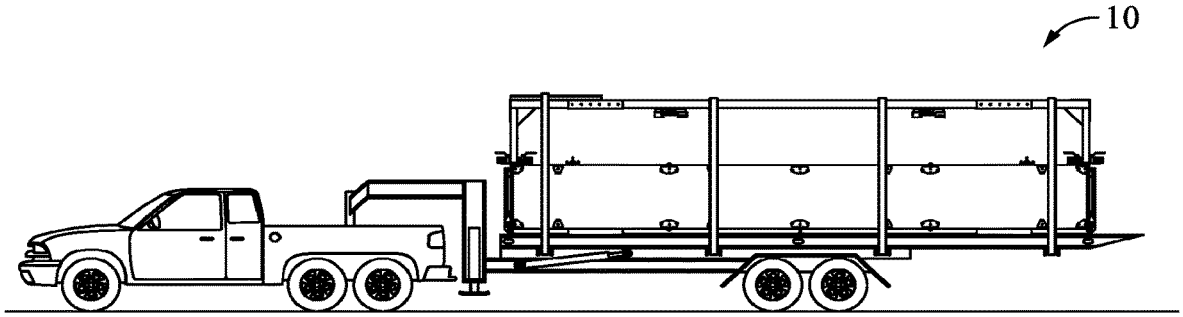
FIGS. 1A-1H provide a schematic for steps of transporting and deploying one embodiment of a storage tank of the invention for use in a method of the invention.
Figure 1B:
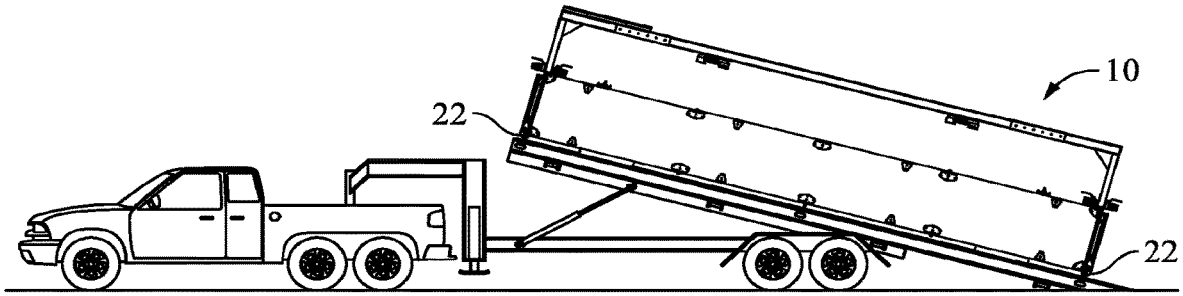
Figure 1C:
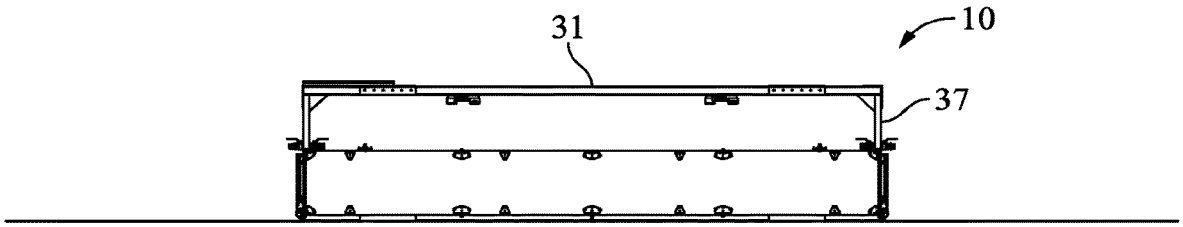

The present invention provides rapidly deploying storage solutions for a litany of fluid products such as chemicals, hydrocarbons, produced water, potable water, and other liquid and liquid-like products. While advantageous for temporary storage, the solutions allowed by the invention can be used for as long as needed, in the field, in a wide range of weather conditions, effectively in whatever above-ground locations humans may find themselves in need of storing large quantities of liquids, such as, for example, 1,200 BBLS.

One example of such a need is in oil producing locations that prohibit transport of oil tankers across roads during certain times of the year when the weight of the tankers would damage the infrastructure of the roads, such as in North Dakota during Fall, Summer and Spring. The present invention allows produced oil, produced water, or other associated fluids to be stored in the field until the roads are usable by tankers, without a need to stop the production during various times throughout the Fall, Summer or Spring months, even when the most restrictive weight restrictions are in effect, at a significant cost savings to the oil production companies.

Another example of such a need in oil producing locations is where large quantities of produced flowback water from enhanced recovery operations such as fracking must be stored. And still another example of such a need in oil producing locations is where large quantities of fresh water, or water treated with chemicals to support enhanced recovery operations such as fracking must be stored. In such operations in both of these examples, the need for storage is temporary and relatively short-lived, a need that the present invention fills quickly and economically.

While the utility of the present invention is quickly appreciated in the oil industry, the utility is not limited to that industry. Those of ordinary skill in the art will appreciate many other uses. For example, temporary storage of large quantities of potable water can be needed in cases of emergencies affecting existing water supplies in communities affected by natural disasters such as flooding or earthquakes. For another example, temporary storage of large quantities of fire fighting chemicals or water can be needed in areas anticipating impending need for fighting approaching wildfires. The storage tank of the invention is also useful for providing temporary or permanent storage of chemicals, hydrocarbons, or other fluids during cleaning of permanent, traditional style metal tanks.

The storage solutions of the present invention are accomplished with a self-contained, pre-assembled, portable fluid storage tank with a flexible fluid storage bladder and secondary containment system capable of holding twenty percent more fluid than the storage bladder. In most embodiments, this storage tank of the invention weighs less than 9,000 pounds so that one truck driver without need for a commercial license can economically move, or transport, the storage tank from place to place.

The tank of the invention is not only sufficiently light in weight but also when closed is sufficiently small in size that it can be transported by a class 1 to class 3 truck, such as for example, a common light body pickup truck such as a Ford F-250 with an accompanying trailer, on common public streets, roadways, and highways, as well as on private roads, and unloaded from the truck, or trailer being pulled by the truck (and later reloaded onto the truck or trailer), at a field site without need for a crane, forklift or specialized unloading equipment. In one embodiment, for example, the storage tank of the invention is about 32 feet long, 8 feet 9 inches wide, and 8 feet 9 inches tall in the closed position. When opened and put in use, this same storage tank can hold 1200 BBLS or 53,400 Gallons. The tank of the invention can typically be deployed for use with a minimum crew of one to five persons in less than about 20 to 120 minutes. Smaller and larger storage tanks can be made with the same features and elements described herein to also have the advantages of the present invention.

The tank of the invention can also be quickly and easily collapsed and made ready for transport and redeployment elsewhere, typically with a minimum crew of one to five persons in less than about 20 to 120 minutes after the tank is drained. The time required for draining the tank will vary with size of the bladder, and the quantity and viscosity of liquids contained in it, but the tank has multiple drainage locations to speed drainage when desired. Moreover, complete or nearly complete drainage of the tank is reasonably practical with the present invention.

Referring to FIGS. 1A-1H, in the method of the present invention, a class 1 to class 3 truck, such as for example a common light body pickup truck such as a Ford F-250 with an accompanying trailer, such as for example a goose-neck trailer, preferably with a pivoting bed or hydraulic lift, delivers a portable storage tank 10 of the present invention to a field site. Such delivery entails essentially dropping the tank from the truck bed or trailer, with no special equipment such as a fork lift needed, much like delivery of a car from a flat-bed tow truck. The aid of a winch on the truck or trailer is desirable.

Upon arrival, a receiving crew of one to five persons prepares the storage tank for use. A larger crew may be used, if desired, although usually as few as two persons or even one person can reasonably prepare the storage tank for use, although the more persons in the crew the faster the set-up, within reasonable limits. Since the storage tank of the invention is pre-assembled and self-contained, preparing it for use entails only a few set-up procedures.

Figure 1D:
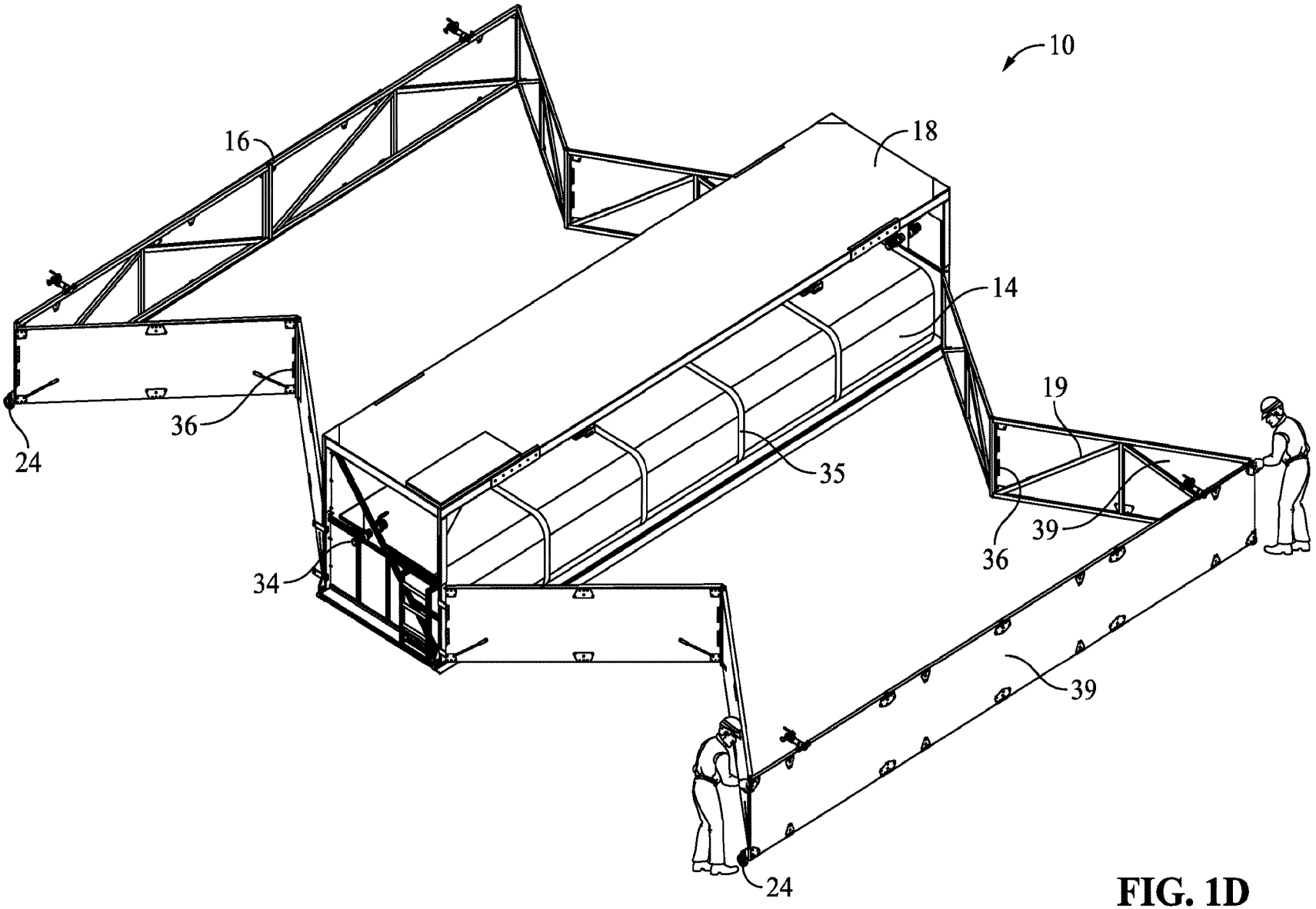

A pin or other latch or holder (not shown, but understood by one of ordinary skill in the art) for keeping the sides of the frame 16 and the bladder 12 and the secondary containment 14 within the control mechanism housing 18, is removed, released, and/or opened so that the receiving crew can pull the frame 16 out, as in FIG. 1D. Wheels 24 at the bottom of or underlying frame 16 (and in one embodiment, positioned at least at the four perimeter corners of the base of the frame), and optional hydraulic arms associated with the frame, can aid in fully extending the frame 16 outward. The frame 16 is comprised of a light but strong metal or metal alloy, such as aluminum and the sides are hinged so that it unfolds as it is being pulled outward to form a parallelogram. The pin or other latch or holder can then be put back in place or otherwise used to at least help hold or lock the frame in position, if needed.

An optional skin 39, comprised of a light weight material, such as, for example, aluminum, can be used on the outside of the frame 16 to prevent wind from removing the secondary containment 14 during use, and to further protect the control mechanism housing 18 and its contents from flying debris on roadways during transport.

Figure 1E:
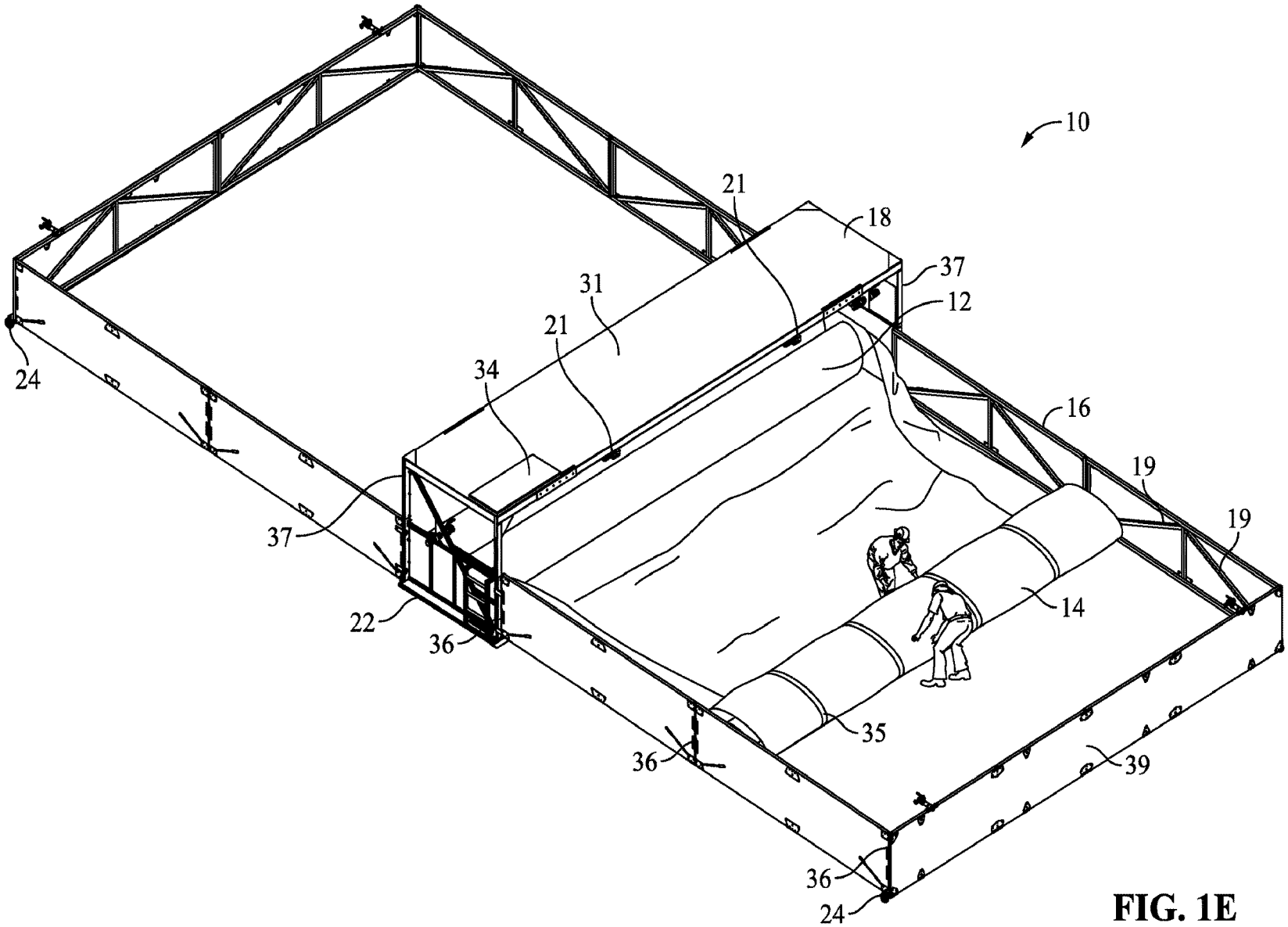
Figure 1F:
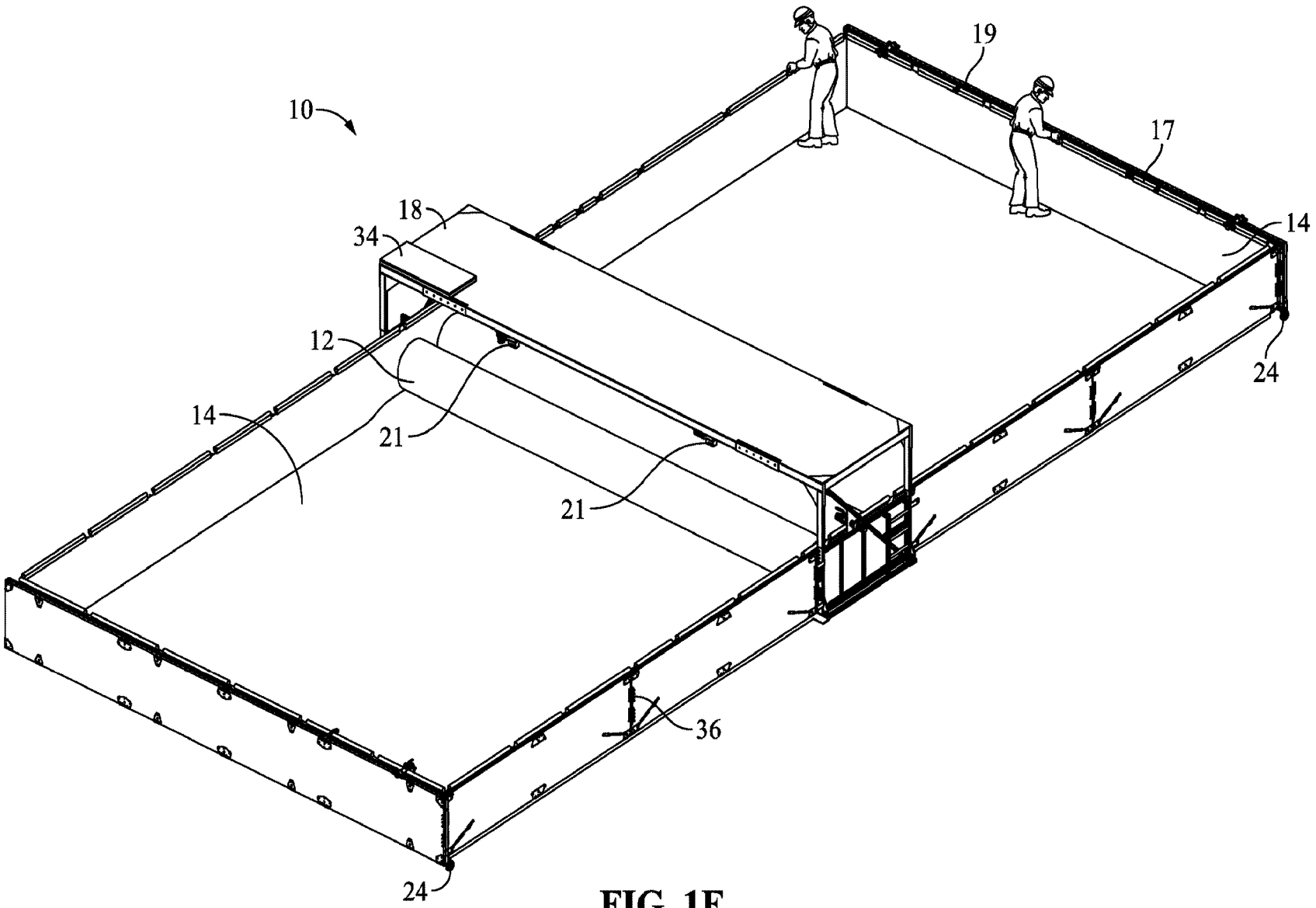

As in FIG. 1E, the receiving crew next pulls out and unfolds the secondary containment 14, with or without aid from a winch 21 housed in the control mechanism housing 18. Secondary containment 14 lies over the extended frame 16, and the edges 17 of the secondary containment 14 are pulled up and attached to the sides 19 of frame 16, as in FIG. 1F. In one embodiment, secondary containment 14 has a rope 28 along edges 17 which is latched to hooks 23 on the sides 19 of frame 16 to effect the attachment of the edges 17 of the secondary containment 14 to the sides 19 of frame 16, as in FIG. 8. Rope 28 is comprised of an abrasion resistant material and in one embodiment is 10 MM in size and the type of rope typically used in climbing.

Figure 1G:
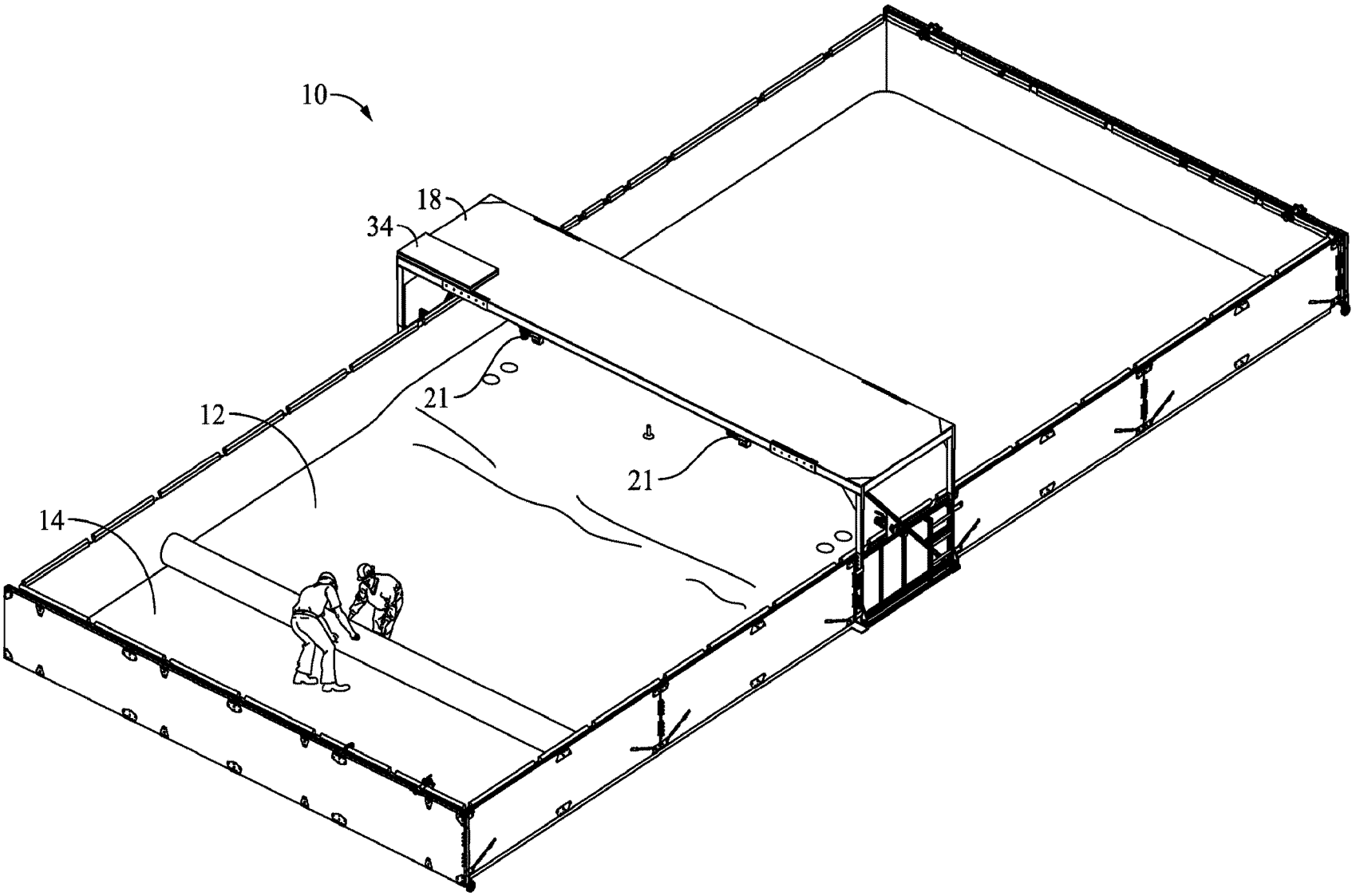
Figure 1H:
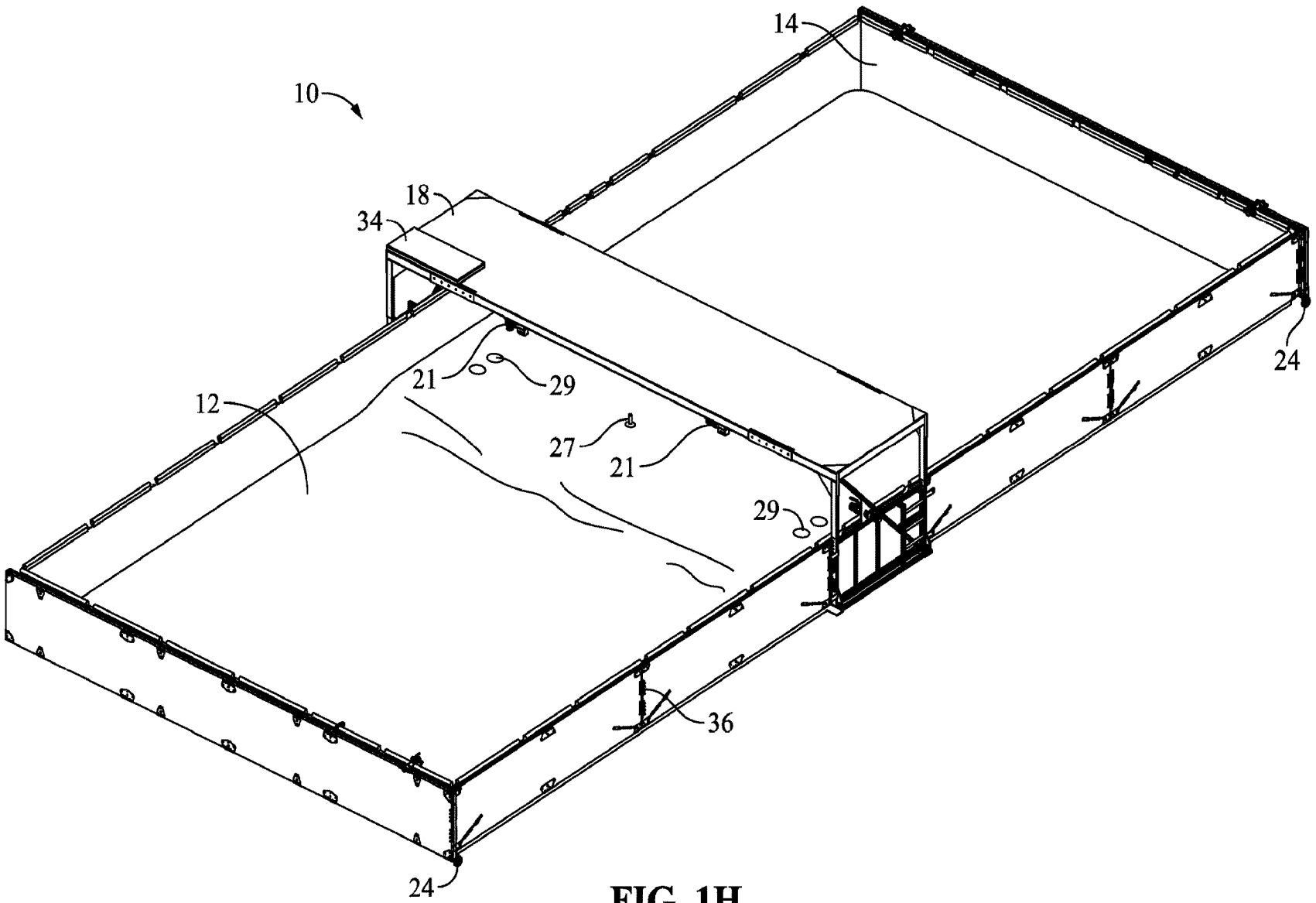

Next the receiving crew unrolls the bladder 12 out from the control mechanism housing 18 and onto the secondary containment 14 lying on the frame 16, as in FIG. 1G. Such roll-out can be accomplished by the crew manually pulling and/or pushing and positioning the bladder 12, or by such manual efforts in combination with help from the winch 21.

The receiving crew then inserts, attaches, or connects one or more hoses or other conduits (and/or manifolds) 20 [see FIGS. 7 and 8] to one or more respective central valves or drains 29 for filling the bladder with liquids for storage (as well as later for draining the bladder). One or more corner drains 25 can also or alternatively be used for filling (and later for draining) the bladder as well if desired. The receiving crew also opens, if needed, a standpipe 27 in the middle of the bladder for venting (as required for certain types of fluid or liquid to be stored, such as, for example, hydrocarbons).

The storage tank 10 of the invention has included with it manifold connections, valves, drains, and a standpipe for venting so as to ease deployment of the storage tank on site for use. In one embodiment, central valve or drain 29 is comprised of a valve system capable of connecting all drains such as drain 25. For example, twelve valves in the system would connect six drains on the bladder. This valve or drain 29 can have ball valve connections that open and close without release of air to the environment (for environmental protection purposes). Further, such valve or drain 29 valve system can be equipped with an optional pollution control pot or fitted with a back-up containment to prevent spillage of liquids when hoses are connected or disconnected. Such valves are welded to the housing, and can be attached to the hoses using standard NPT threading or unionid.

The storage tank 10 of the invention is then ready to receive fluid or liquid into bladder 12. Such fluid may be pumped into the storage tank or drained into the storage tank, depending on the source of the fluid. For example, for use of the storage tank 10 in holding flowback water from fracking operations, or from standard oilfield production, a hose or other conduit (or manifold) 20 could be connected (directly or indirectly) to the flowline from the wellhead, or from the oilfield tank battery if one exists. For another example, for use of the storage tank 10 in holding oil or water from flowback operations, a hose or other conduit (or manifold) 20 could be connected (directly or indirectly) to the flowline from the wellhead, before an oilfield tank battery has been constructed. An advantage of the bladder 12 of storage tank 10 is that it can be filled closer to nominal capacity than all-metal storage tanks.

Figure 5A:
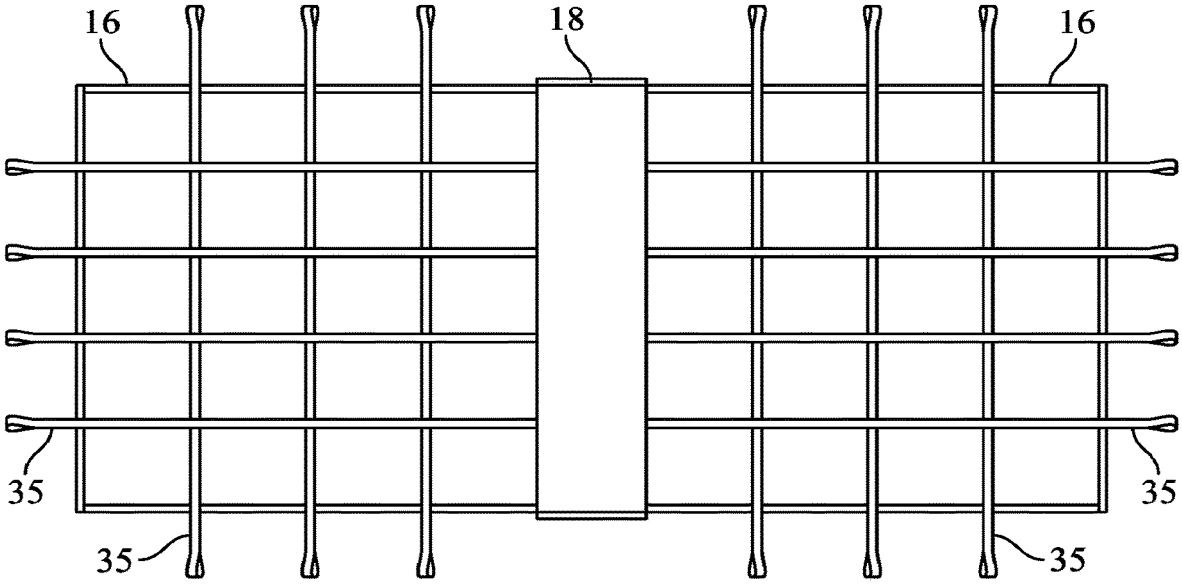
FIG. 5A is one example pattern of straps as attached to the underside of the secondary containment (that is, the side adjacent the frame and opposite the site that will be adjacent the bladder), in one embodiment of the storage tank of the invention, for use in cooperation with a winch in the control mechanism housing for aid in handling the secondary containment. In this embodiment of the storage tank of the invention, a similar or identical pattern of straps can be attached alternatively or additionally to the underside of the bladder (that is, the side adjacent the secondary containment), for use in cooperation with a winch in the control mechanism housing for aid in handling the bladder.
Figure 5B:
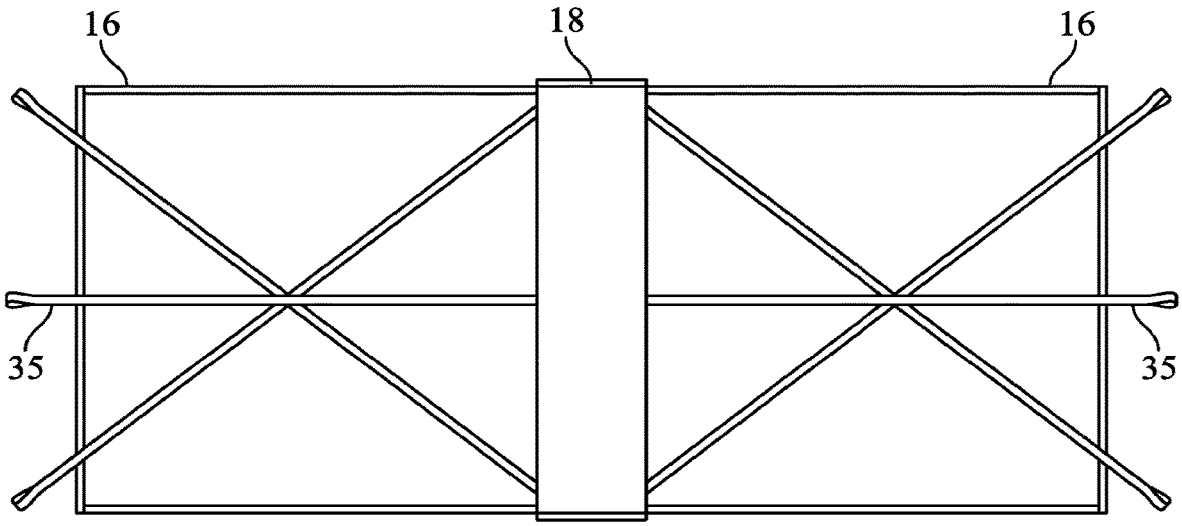
FIG. 5B is an alternative example pattern of straps as attached to the underside of the secondary containment (that is, the side adjacent the frame and opposite the site that will be adjacent the bladder), in an alternative embodiment of the storage tank of the invention, for use in cooperation with a winch in the control mechanism housing for aid in handling the secondary containment. In this embodiment of the storage tank of the invention, a similar or identical pattern of straps can be attached alternatively or additionally to the underside of the bladder (that is, the side adjacent the secondary containment), for use in cooperation with a winch in the control mechanism housing for aid in handling the bladder.
Figure 7:
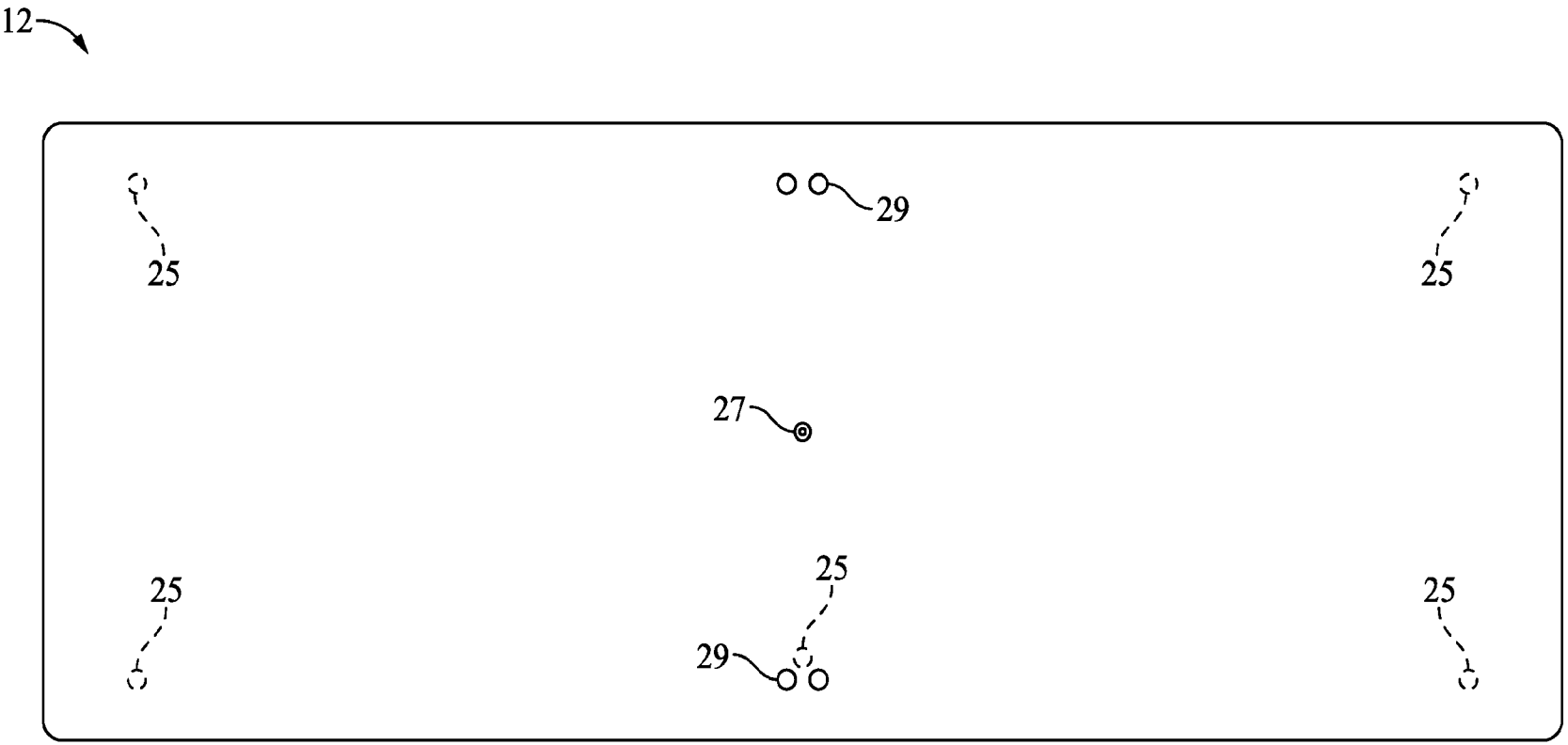
FIG. 7 is a top view of the bladder of one embodiment of the storage tank of the invention, as it would be or is spread across the secondary containment on the frame, showing the location of a standpipe and six connection points or drains for filling and draining the tank.
Figure 8:
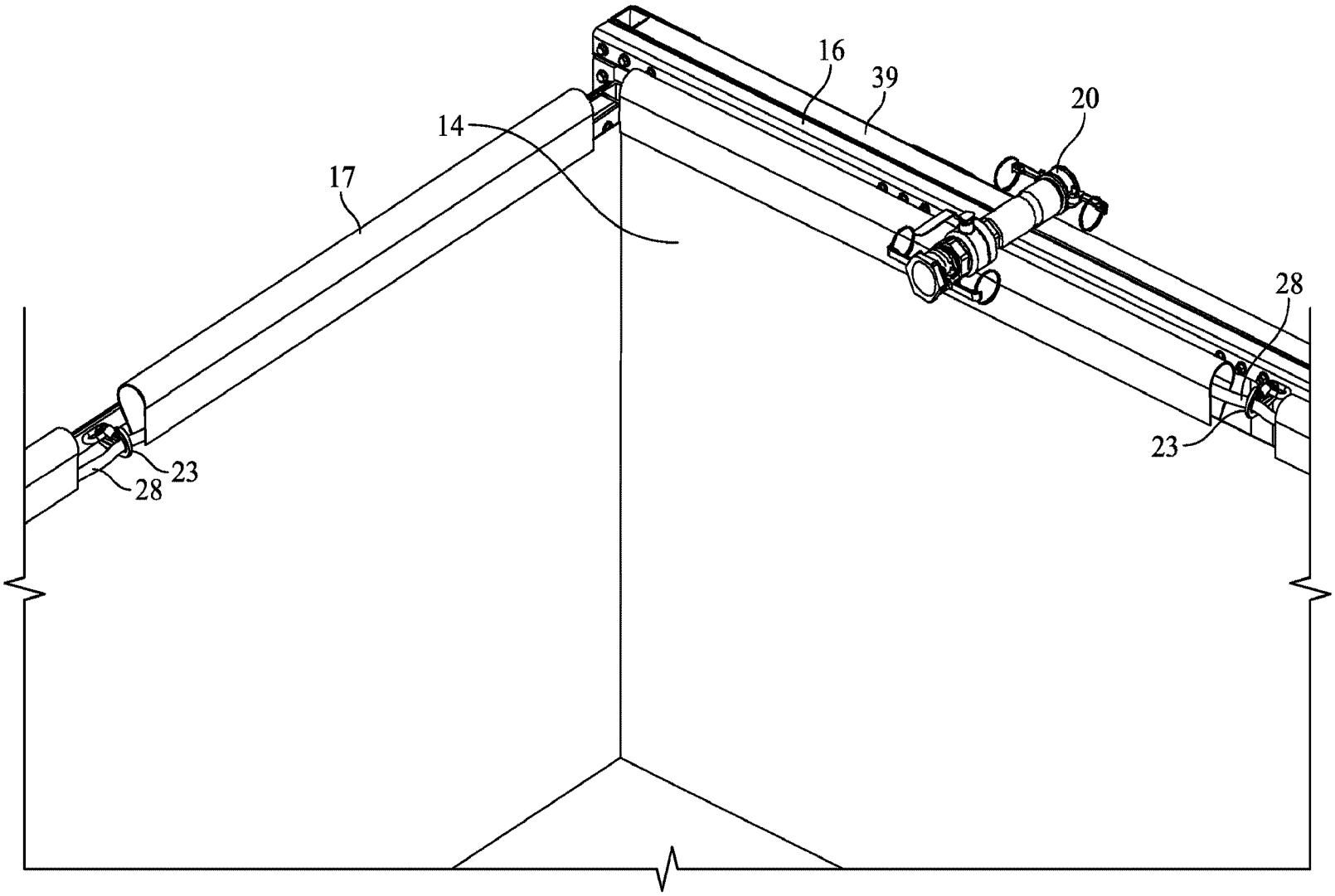
FIG. 8 is a close-up view of the secondary containment spread out and attached to the sides of the frame of the storage tank of the invention, before the bladder has been spread on top of the secondary containment.
Figure 9:
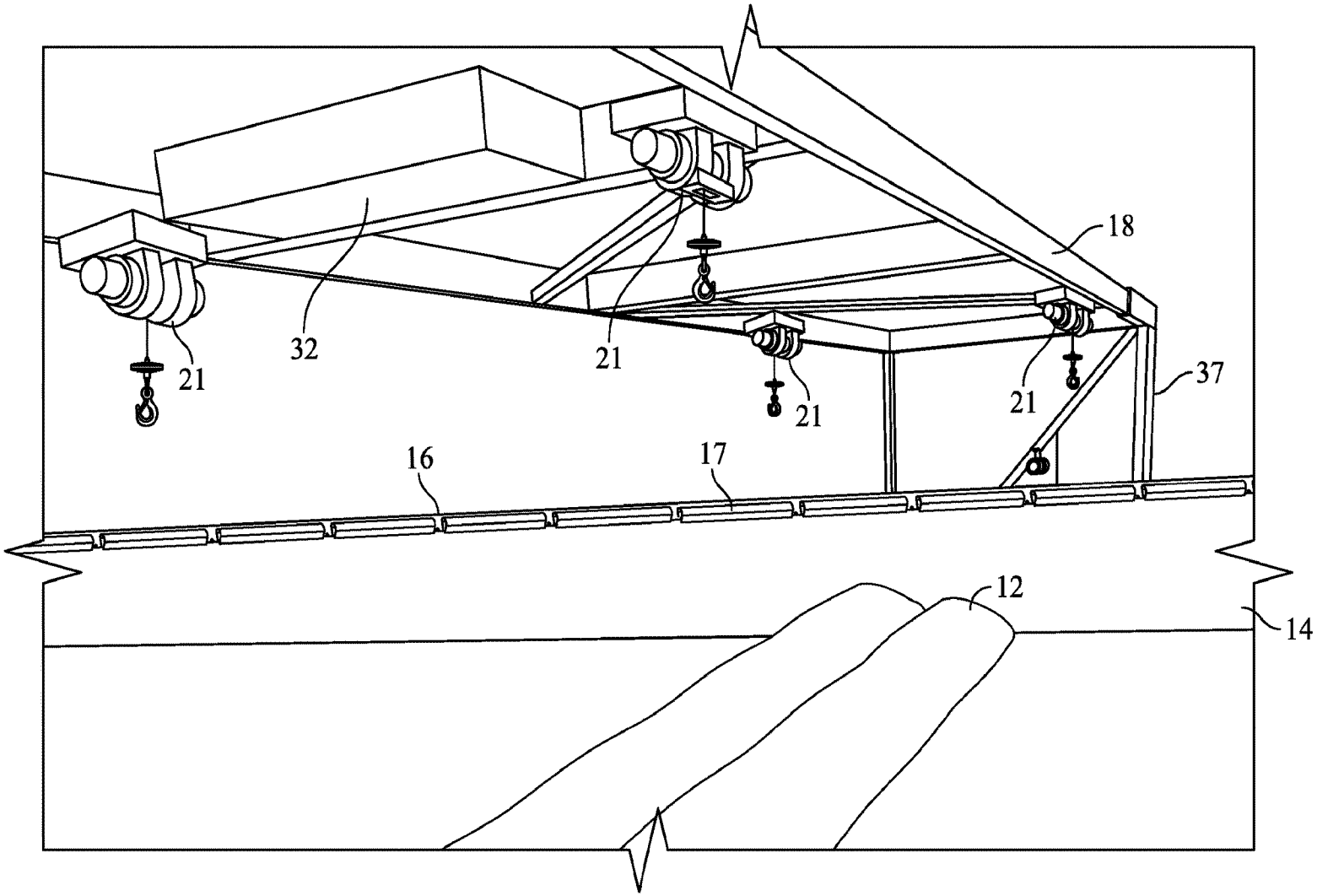
FIG. 9 is a close-up view of the control mechanism housing of one embodiment of the storage tank of the invention showing the positioning of the winch and battery for operation of the winch.

The storage tank 10 has multiple corner drains 25 and central drains 29 as shown in FIG. 7 for draining the fluid out of the storage tank 10 when transport, disposal, or other movement or repositioning of the stored fluid is desired. Such drainage may be accomplished by pump or by gravity-flow drainage or both. Also, an advantage of the storage tank 10 of the invention is that straps 35, as shown in two different example embodiments in FIGS. 5A and 5B, can be used in association with the winch 21 to pull-up a portion of the secondary containment 14 and/or the bladder 12 to move the bladder to a height and/or in a direction, especially toward a particular desired corner drain 25 or central drain 29, to facilitate faster and more complete drainage of the bladder. For this purpose straps 35 can be can be used on either the secondary containment, the bladder, or both, although such straps 35 are not necessary for operation of the invention. Storage tank 10 can be quickly and essentially or substantially depleted (at least less than about 10 percent of fluids remaining), to a greater degree than is common for all-metal storage tanks.

Straps 35 can also be used with winch 21 in deploying for use and retracting for storage and transport the bladder 12 and the secondary containment 14. Straps 35 are, in one embodiment, comprised of a web of nylon or other synthetic capable of handling the weight the winch 21 can pull, which in the embodiment illustrated is typically about 16 thousand pounds. The straps 35 can be heat melted to the bladder 12 or the secondary containment 14 via a fabric patch, in such way that if it were torn it would not compromise the integrity of the bladder or secondary containment.

Figure 10A:
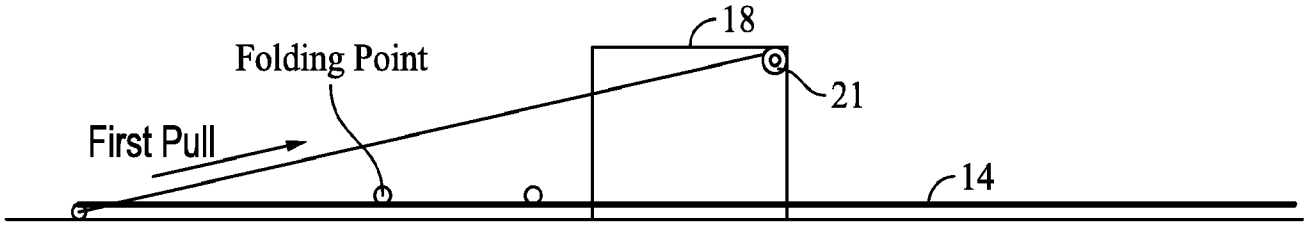
FIGS. 10A-10C provide a schematic showing the effects of a series of pulls of the winch in the control mechanism housing on the secondary containment, folding the secondary containment for storage within the control mechanism housing.
Figure 10B:
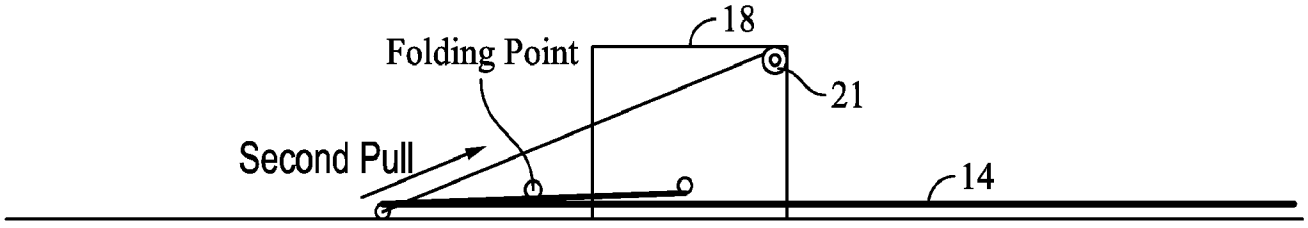
Figure 10C:
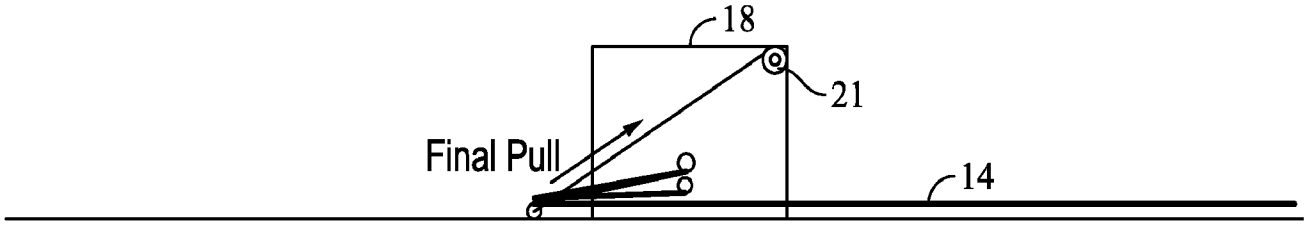

Once drained, storage tank 10 can be made ready for transport to another site effectively reversing the set-up procedure described above. Any pin or other latch or holder holding the frame in place is removed. All valves (not shown) associated with corner drains 25 and/or central drains 29 are closed, standpipe 27 is closed, and the bladder 12 is rolled back up or folded (manually and/or with winch 21) and stored in control mechanism housing 18. In one embodiment, the edges 17 of secondary containment 14 are released from the sides 19 of frame 16, and the secondary containment 14 is pulled back and folded, as shown in FIG. 10, by winch 21 and stored in the control mechanism housing 18 above the now rolled bladder 12. In an alternative embodiment, the secondary containment 14 is left attached to the frame during storage and transport. Frame 16 is then pushed back, and folded back at its hinges 36, or in a sense, collapsed, so that it fits against the bladder 12 and inside the control mechanism housing 18. A pin or other latch or holder (not shown) is then inserted or applied to hold the frame 16 in place, as would be understood by one of ordinary skill in the art. Storage tank 10 is then lifted onto a trailer being pulled by a class 1-class 3 truck, such as for example, a common light body pickup truck such as a Ford F-250, with the help of a hydraulic assist or a winch on the truck or trailer, and storage tank 10 is ready for transport.

Referring to FIGS. 2-11 for more details of the portable, pre-assembled, self-contained storage tank 10 of the invention for holding or containing fluids, the collapsible and refillable bladder 12 of storage tank 10 for receiving and storing the fluids is comprised of a natural or synthetic rubberized fabric, soft or flexible plastic, para-aramid or aramid synthetic fiber, or other flexible and substantially impenetrable material with sufficient strength and toughness to resist rupturing from the weight of the liquids, even when moved or pressed at times from external sources. In use, the bladder 12 is closed so that the liquids are not open to the air. An advantage of the bladder is that it is significantly lighter in weight than metal storage tanks typically used for storing fluids such as chemicals. The flexibility of the bladder material also enables the bladder to be more readily collapsible for ease of portability.

The description and Figures herein generally show that bladder 12 extends from both sides of control mechanism housing 18, and in deployment is rolled out from both sides of the control mechanism housing 18. In such case, bladder 12 may be one large bladder, with half on one side of the control mechanism housing 18 and the other half on the other side of the control mechanism housing 18, as shown in FIGS. 1-H and 6. In another embodiment, bladder 12 comprises two separate bladders, one on one side of the control mechanism housing 18 and the other on the other side of control mechanism housing 18. In still another embodiment, however, typically when lower volumes of fluid need be stored, bladder 12 is only unrolled on one side of the control mechanism housing 18. And in a further embodiment, the storage tank 10 can only have a bladder, secondary containment and frame that comes out from one side of the control mechanism housing 18.

Figure 6:
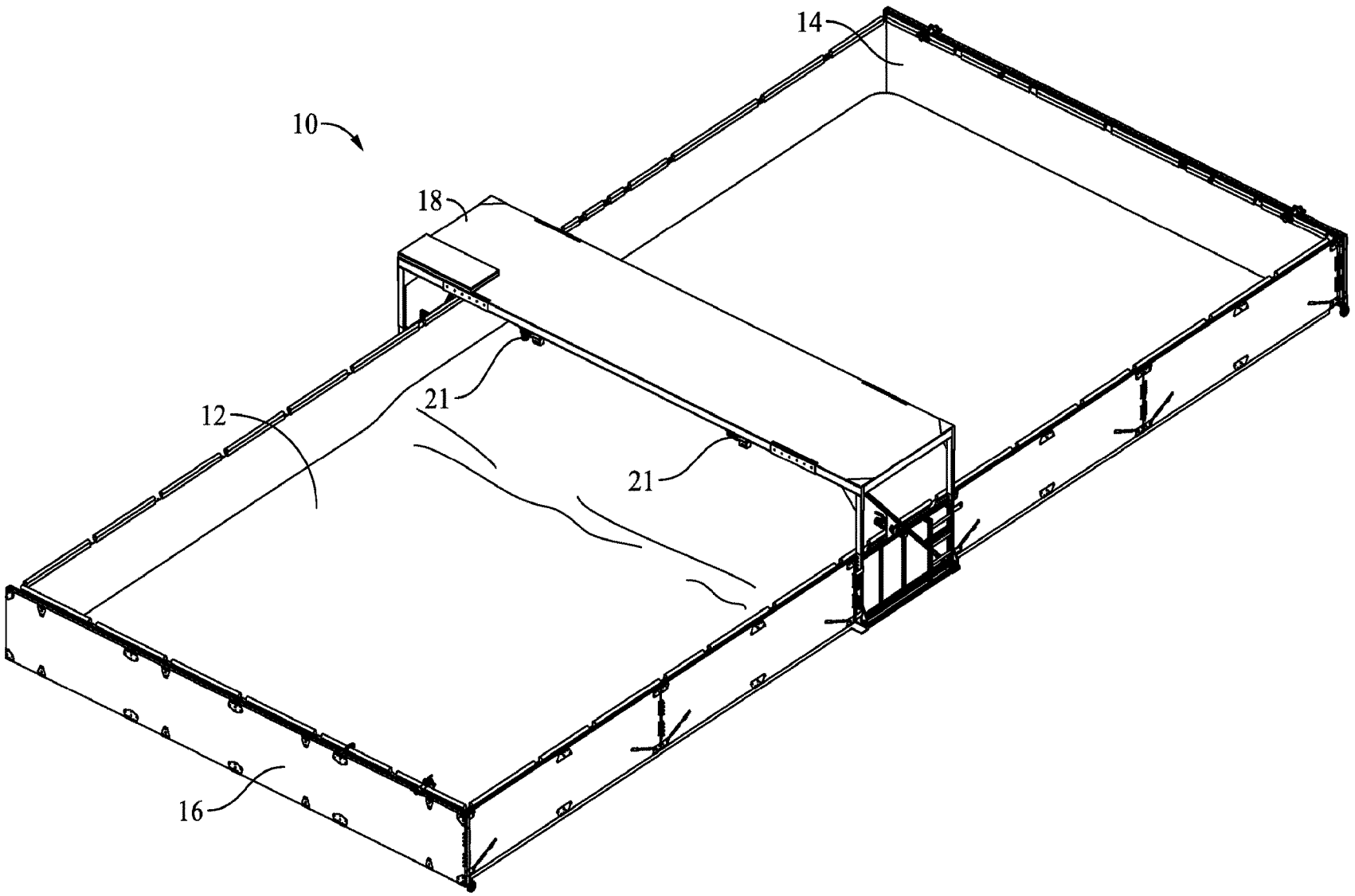
FIG. 6 is a perspective view of the storage tank of FIG. 4, with the sides or edges of the secondary containment attached to the sides or edges of the frame and the bladder unrolled and positioned atop the secondary containment, on both sides of the control mechanism housing.

Bladder 12 is associated with a secondary containment 14. In one embodiment, secondary containment 14 is capable of containing 20 percent more liquid than bladder 12. The secondary containment 14 is comprised of a natural or synthetic rubberized fabric, soft plastic, para-aramid or aramid synthetic fiber, or other flexible and substantially impenetrable material with strength and toughness, and in one embodiment is comprised of the same kind of material as the bladder 12. In one embodiment, bladder 12 lies atop secondary containment 14, as shown in FIG. 6. In one embodiment, secondary containment 14 surrounds bladder 12, also as shown in FIG. 6. In one embodiment, secondary containment 14 is attached to bladder 12 (not shown). The purpose of secondary containment 14 is to impart to the tank a safety or back-up holding capability in case the bladder wall is penetrated and leakage of its contents results.

Frame 16 holds and supports secondary containment 14 and bladder 12 while in use, as shown in FIG. 6. Frame 16 is comprised of a sturdy, light-weight and strong metal such as, for example, aluminum or steel, a metal alloy, or a synthetic material with at least or about the hardness and strength of metals such as aluminum or steel.

The control mechanism housing 18 has an aluminum, steel or metal alloy base or skid 22 that enables the storage tank 10 to be suited for light or medium duty truck transport on public and private roads. As shown in the Figures, control mechanism housing 18 also has a top 31, a housing frame 37, and partial side ends 33, leaving the control mechanism housing 18 partially open. In another embodiment, control mechanism housing 18 is or can be completely closed, with sides and side ends extending from the base 22 to the top 31. Side ends 33 and top 31 are comprised of aluminum, steel, or metal alloy, in one embodiment. In another embodiment, side ends 33 could alternatively be comprised of a lighter weight material such as a strong synthetic composition.

Figure 2:
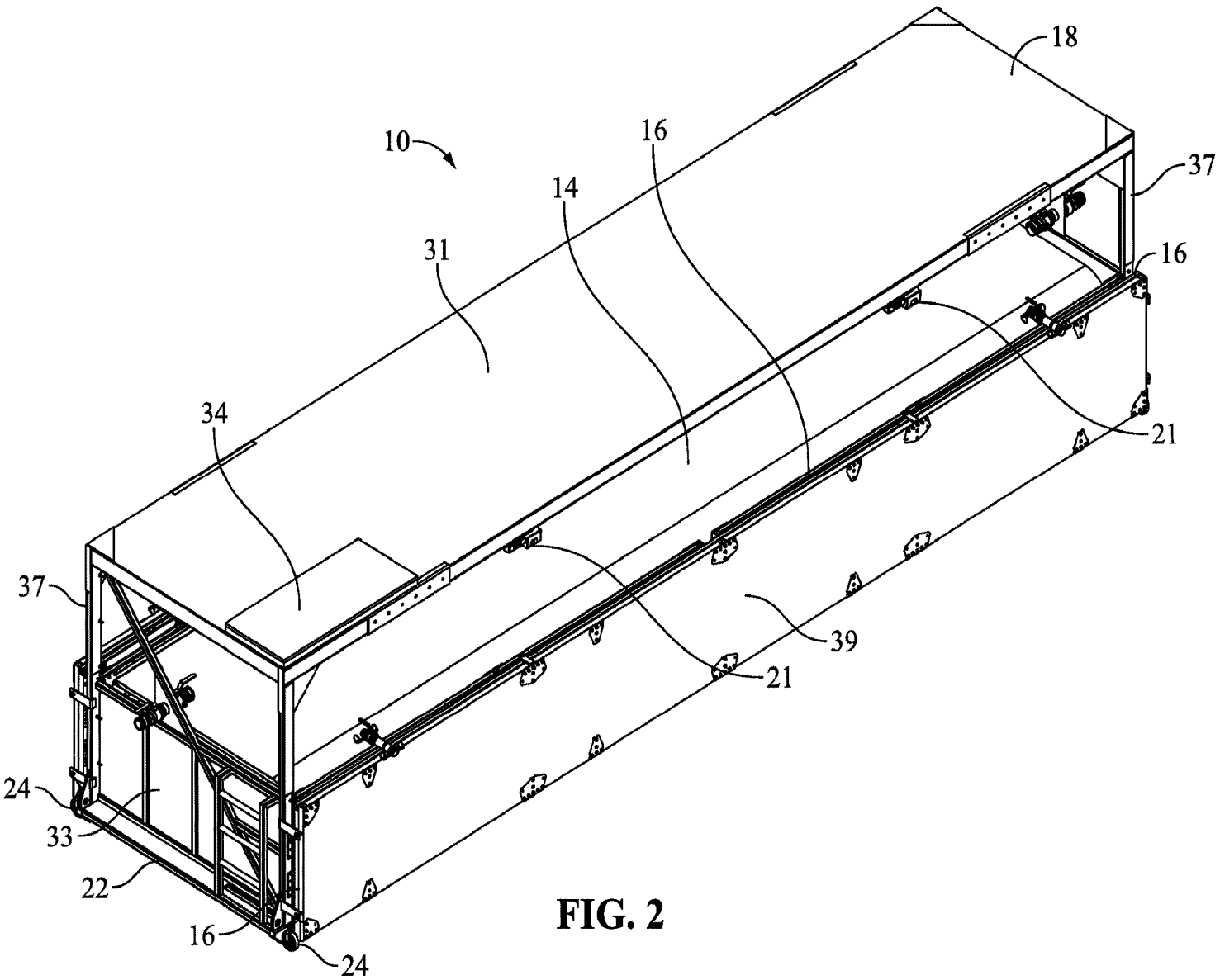
FIG. 2 is a perspective view of one embodiment of the storage tank of the invention, closed and ready for transport to a site for use.
Figure 3:
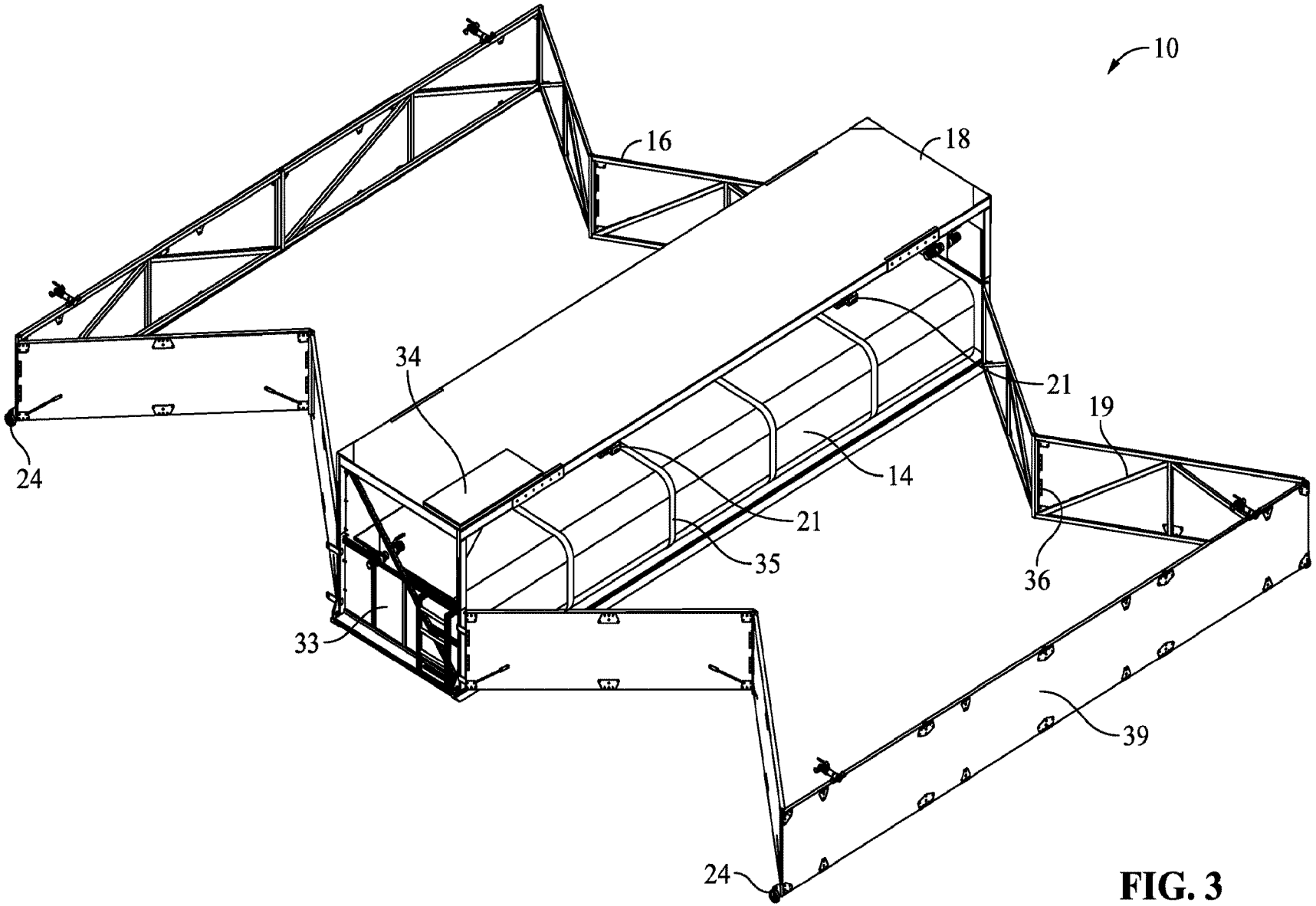
FIG. 3 is a perspective view of the storage tank of FIG. 2 as the frame is partially pulled out and unfolded from the control mechanism housing.
Figure 4:
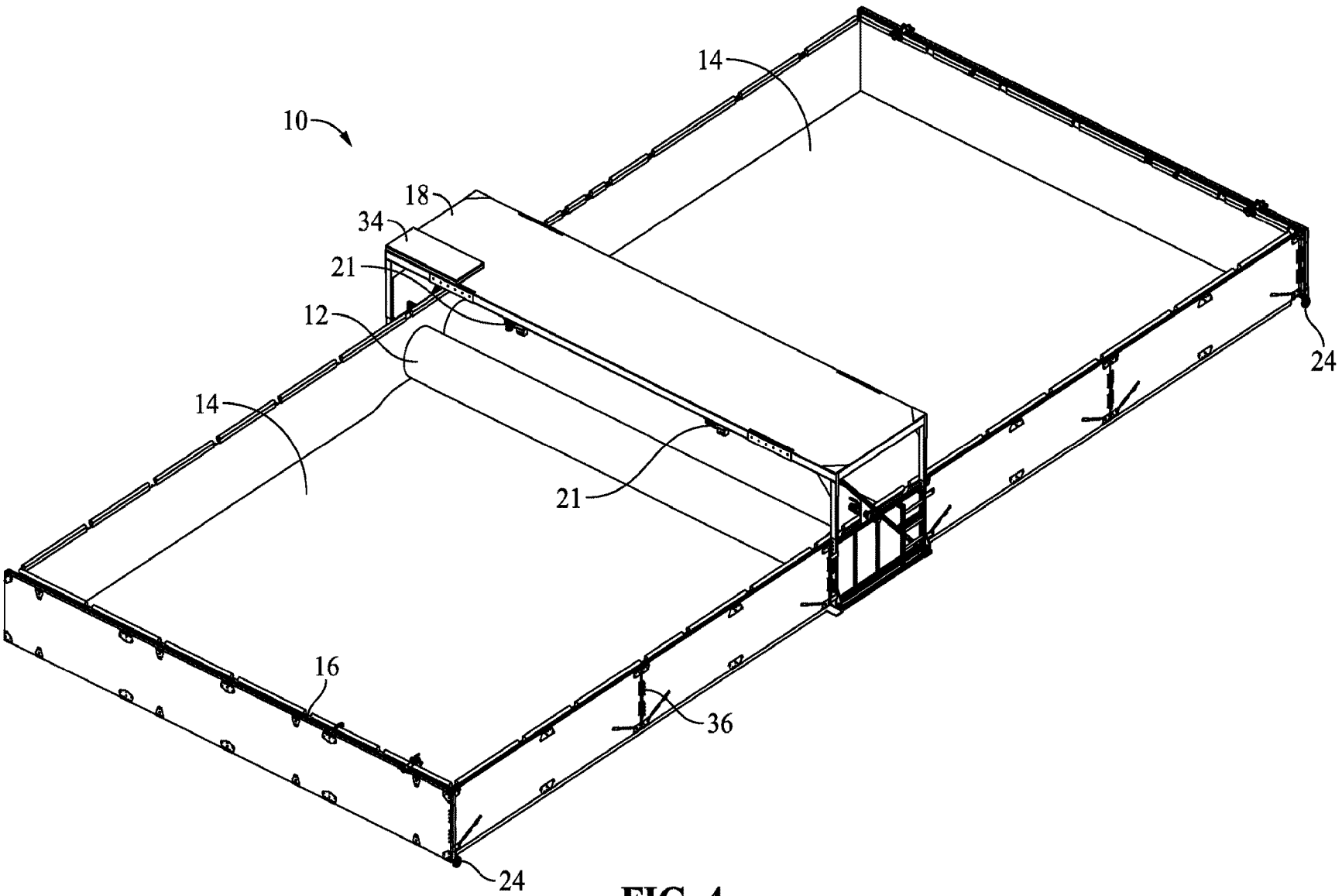
FIG. 4 is a perspective view of the storage tank of FIG. 2 with the frame in place for use and the secondary containment deployed on the frame.
Figure 11:
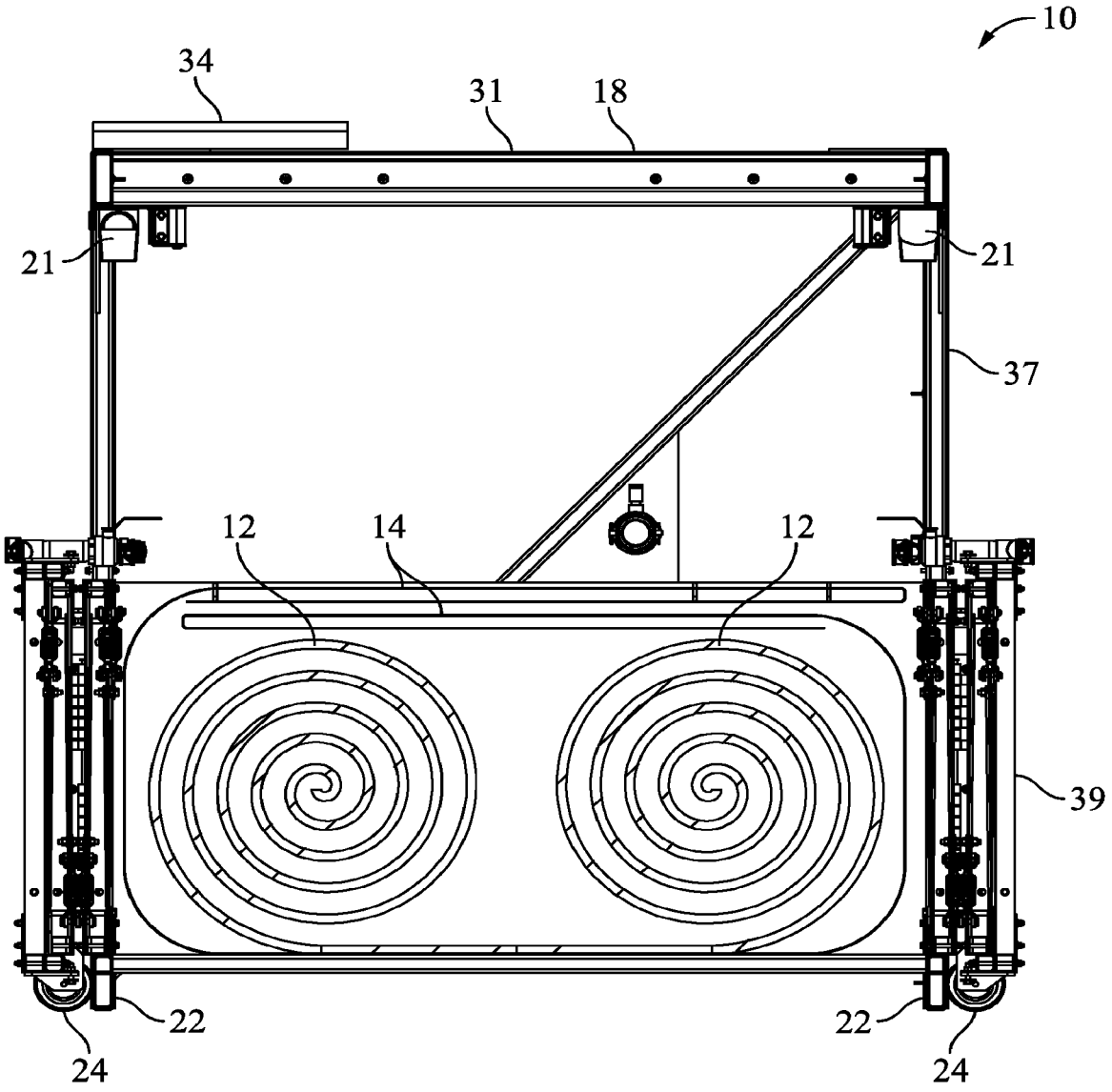
FIG. 11 is a cut-away end view of the storage tank of FIG. 2.

As discussed above, when not in use, and for transport, bladder 12 and secondary containment 14 can be rolled or folded into the control mechanism housing 18, and frame 16 can also be collapsed or folded back into the control mechanism housing 18, as shown in FIGS. 2 and 11. One or more winches 21 positioned under the top 31 of the control housing mechanism 18 provides mechanical assist for such rolling and folding of the bladder 12, secondary containment 14 and frame 16. The control mechanism housing 18 also contains one or more batteries 32 for powering the one or more winches 21, and the control mechanism housing 18 has on its top 31 a solar panel 34 for supplementing power to and/or recharging the batteries 32. Connections of the one or more batteries 32 to the one or more winches 21 and to the solar panel 34 would be understood by one of ordinary skill in the art.

An operator uses hoses or other similar conduits or manifold 20 and connectors known to those of ordinary skill in the art to connect the storage tank 10 to the source of the fluid to be received into and retained in the storage tank 10. Such source can be any vessel or container that needs to be emptied, fluid hauling truck, tank, well or pump from any source that can send liquid or fluid to bladder 12 until filled. Liquid or fluid can remain in storage tank 10 until such time as the liquid or fluid can be transported to a desired destination or pumped out via a truck, pipeline or other apparatus.

Storage tank 10 of the invention provides very light weight and rapidly deploying fluid containment and secondary containment of fluids or liquids where weight, size, or footprint are an issue, or where permanent rigid tanks are impractical, cost prohibitive or unnecessary.

The storage tank of the invention and its rapid deployment system is the only uniquely designed non-rigid storage product that, due to its high portability and low weight design, allows for a tank of significant size to be transported across highways, county roads, or other roads that are under the most restrictive of weight restrictions due to weather, Spring or Fall frost, or other applicable weight restrictions. The storage tank of the invention has significantly less weight when combined with the trailer than similar sized steel or metal tanks. The storage tank of the invention can also be deployed without the use of a crane, unlike steel or other tanks of similar size, and without need to dig and maintain a berm or secondary containment.

While preferred embodiments of the present invention have been described, it should be understood that other various changes, adaptations and modifications can be made therein without departing from the spirit of the invention and the scope of the appended claims. The scope of the present invention should, therefore, be determined not with reference to the above description, but instead should be determined with reference to the appended claims along with their full scope of equivalents. Furthermore, it should be understood that the appended claims do not necessarily comprise the broadest scope of the invention which the applicant is entitled to claim, or the only manner(s) in which the invention may be claimed.

APPENDIX—LIST OF ELEMENTS

10 Tank
12 Bladder
14 Secondary containment
16 Frame
17 Edge of secondary containment 14
18 Control mechanism housing
19 Sides for frame 16
20 Hoses or other conduits or manifold
21 Winch
22 Base or skid of control mechanism housing
23 Hook
24 Wheels
25 Corner drain and valve system
27 Standpipe vent with cover
28 Rope
29 Central drain and valve system
31 Top of control mechanism housing
32 Battery
33 Side ends of control mechanism housing
34 Solar Panel
35 Straps
36 Hinges
37 Housing frame
39 Skin over outside of Frame 16

I claim:

1. A pre-assembled, self-contained, portable storage tank for storage of fluids or liquids, comprising:

a collapsible and refillable bladder for receiving and storing the fluids or liquids and comprising input and output connections or conduits associated with valves for configuring and controlling flow of liquid into and out of the bladder;

a secondary containment capable of holding more fluid or liquid than the bladder, positioned beneath and at least partially along the sides of said bladder so as to contain any or all liquid from the bladder during any leakage from the bladder;

an expandable and retractable frame for holding or supporting the bladder and the secondary containment, having optional wheels thereunder for rolling the frame when expanding or retracting; and a housing for housing or holding the bladder, secondary containment and frame when or if the bladder, secondary containment and frame are not in use;

wherein the tank is sufficiently pre-assembled that it can be put into use by a receiving crew of two to five persons at the site of delivery, without need for digging a berm, without need of using a crane or a forklift to lift any part of the tank, and without need of assembling the tank beyond set-up procedures.

2. The tank of claim 1 wherein the tank weighs less than 9000 lbs and when closed and containing the at the bladder, secondary containment, and frame, is sufficiently compact that it can be transported to a site for use by a class 1 to a class 3 truck, with or without an accompanying trailer.

3. The tank of claim 2 wherein the bladder can provide closed liquid storage for at least or about 1200 BBLS or about 53,400 gallons of fluid or liquid.

4. The tank of claim 3 wherein the tank can be put into use by the receiving crew of two to five persons at the site of delivery within 20 minutes to 120 minutes.

5. The tank of claim 4 wherein the tank can be prepared for transport by two to five persons within 20 to 120 minutes after drainage of fluids from the bladder.

6. The tank of claim 3 that can be used for storing liquids in all weather conditions and known environments habitable by humans.

7. The tank of claim 1 wherein the frame is covered by an outer skin.

8. The tank of claim 1 wherein the bladder and secondary containment are comprised of the same material.

9. The tank of claim 1 wherein in deployment, the frame has wheels thereunder and is expanded outward from the housing in a horizontal plane and the bladder and secondary containment are rolled outward from the housing onto the frame.

10. The tank of claim 1 wherein after draining the bladder, in preparing the tank for non-use or transport, the bladder and secondary containment at least partially automatically roll or move back into the housing and the frame at least partially folds back into the control mechanism housing.

11. The tank of claim 1 for storing water or hydrocarbons, wherein the bladder is comprised of natural or synthetic rubberized fabric, plastic, para-aramid or aramid synthetic fiber.

12. A method for temporary storage of fluids during production operations at a well site for recovery of hydrocarbons, said well site having a at least one well producing backflow fluids through at least one flowline, the method comprising:

deploying the pre-assembled, self-contained, portable storage tank of claim 1 near the well site;

connecting said storage tank to the at least one flowline; and allowing the backflow fluids to drain into the storage tank.

13. The method of claim 12 wherein the connection between the tank or the flowline comprises at least one conduit or hose.

14. The method of claim 12 wherein said well site has an oilfield tank battery for receiving backflow fluids but said oilfield tank battery is at capacity or otherwise unable to accept backflow fluids for storage when the pre-assembled, self-contained, portable storage tank is used.

15. The method of claim 12 wherein said well site does not have an oilfield tank battery for receiving backflow fluids and use of the pre-assembled, self-contained, portable storage tank avoids having to shut-in or shut-down the well.

16. The tank of claim 1 for use in a method for temporary storage of fluids during refining, petrochemical, or oilfield production operations where produced hydrocarbons, chemicals or water mixed with hydrocarbons from tank cleaning, turnaround operations, or temporary abandonment of permanent tanks for painting or maintenance, necessitate the need for said temporary storage.

17. The tank of claim 1 for use in a method for temporary storage of fluids during emergency management operations associated with a hurricane, firefighting, flooding, or other natural disaster necessitating temporary quick and economical storage of fluids with provision for secondary containment.

18. A method for temporary storage of fluids during a fracking operation at a well site for enhanced recovery of hydrocarbons, said well site having a well head and a flow line receiving backflow fluids, the method comprising:

deploying the pre-assembled, self-contained, portable storage tank of claim 1 near the well site;

connecting said tank to the flowline receiving the backflow fluids; and allowing the backflow fluids to drain into the tank.

19. The method of claim 18 wherein the connection between the tank and the flowline or well head comprises at least one conduit or hose.

20. A method for temporary storage of a first fluid and a second fluid for use in mixing chemicals during and for use in fracking operations at a well site for recovery of hydrocarbons, said well site having the need to store and make ready said first and second fluids for use in the fracking operations, the method comprising:

(1) deploying at or near said well site a pre-assembled, self-contained, portable storage tank for storage of said first and second fluids, said storage tank comprising:

a first collapsible and refillable bladder for receiving and storing the first fluid and a second collapsible and refillable bladder for receiving and storing the second fluid, wherein the first and second bladders each comprise input and output connections or conduits associated with valves for configuring and controlling the flow of fluid into and out of said bladders;

a secondary containment capable of holding more fluid than the first and second bladders, positioned beneath and at least partially along the sides of said bladders so as to contain any or all fluid from said bladders during any leakage from the bladders;

an expandable and retractable frame for holding or supporting the bladders and the secondary containment, having wheels thereunder for rolling the frame when expanding or retracting;

at least one winch for at least partially automating the unfolding, folding, rolling, unrolling, or storing of the bladders or the secondary containment;

and a control mechanism housing for housing or holding the at least one winch, and when or if the bladders, secondary containment, and frame are not in use, for housing or holding the bladders, secondary containment and frame;

wherein the tank is sufficiently pre-assembled that it can be put into use by a receiving crew of two to five persons at the site of delivery, without need for digging a berm, without need of using a crane or a forklift to lift any part of the tank, and without need of assembling the tank beyond set-up procedures; and (2) connecting said tank to a mixing station or one or more pumping trucks at the well site.

21. The method of claim 20, wherein the first bladder and the second bladder receive different fluids for storage and fluid is provided to the mixing station or to one or more pumping trucks from the first bladder independent of fluid provided to the mixing station or to one or more pumping trucks from the second bladder.

* * * * *